US011466931B2

(12) United States Patent
Mathis, Jr. et al.

(10) Patent No.: US 11,466,931 B2
(45) Date of Patent: Oct. 11, 2022

(54) VIBRATORY APPARATUS WITH SEGMENTED DISTRIBUTOR DECK

(71) Applicant: General Kinematics Corporation, Crystal Lake, IL (US)

(72) Inventors: Oscar L. Mathis, Jr., Cary, IL (US); Yong Wei, Crystal Lake, IL (US)

(73) Assignee: General Kinematics Corp., Crystal Lake, IL (US)

( * ) Notice: Subject to any disclaimer, the term of this patent is extended or adjusted under 35 U.S.C. 154(b) by 2 days.

(21) Appl. No.: 16/787,766

(22) Filed: Feb. 11, 2020

(65) Prior Publication Data

US 2020/0256617 A1 Aug. 13, 2020

Related U.S. Application Data

(60) Provisional application No. 62/804,142, filed on Feb. 11, 2019.

(51) Int. Cl.

| | |
|---|---|
| ***F26B 9/00*** | (2006.01) |
| ***F26B 3/092*** | (2006.01) |
| ***F26B 17/10*** | (2006.01) |
| ***F26B 21/00*** | (2006.01) |

(52) U.S. Cl.

CPC ..... *F26B 3/0923* (2013.01); *F26B 17/10* (2013.01); *F26B 17/106* (2013.01); *F26B 21/00* (2013.01)

(58) Field of Classification Search

CPC ..... F26B 3/0923; F26B 17/10; F26B 17/106; F26B 17/26; F26B 21/00; F26B 2200/08; F26B 3/06

USPC ..... 34/164, 249, 323

See application file for complete search history.

(56) References Cited

U.S. PATENT DOCUMENTS

| | | | | |
|---|---|---|---|---|
| 4,033,555 | A * | 7/1977 | Fong | F26B 3/0926 366/101 |
| 5,695,701 | A * | 12/1997 | Funder | B01J 8/44 425/222 |
| 8,863,959 | B1 | 10/2014 | Britton et al. | |
| 9,238,229 | B1 | 1/2016 | Kempf et al. | |
| 9,759,483 | B1 * | 9/2017 | Bero | F26B 3/0926 |
| 10,124,963 | B1 | 11/2018 | Steffes, Jr. | |

(Continued)

FOREIGN PATENT DOCUMENTS

| | | | | |
|---|---|---|---|---|
| JP | 54011562 | * | 6/1977 | F26B 17/26 |
| JP | S5411562 | | 1/1979 | |

(Continued)

OTHER PUBLICATIONS

International Search Report and Written Opinion, counterpart application No. PCT/US2020/017717 (dated Aug. 3, 2020) (21 pages).

*Primary Examiner* — John P McCormack
(74) *Attorney, Agent, or Firm* — Cook Alex Ltd.

(57) ABSTRACT

A vibratory fluidized bed dryer includes a deck with a surface on which a bed of materials is formed, the deck having apertures through which air passes to fluidize the bed of materials on the deck, a source of air coupled to the apertures in the deck to supply air to the bed through the apertures in the deck, and a vibration generator coupled to the deck. The deck has at least two zones, each zone having a different open area percentage, such that the air passing through each zone produces a different superficial velocity.

14 Claims, 3 Drawing Sheets

(56) References Cited

U.S. PATENT DOCUMENTS

| | | | | |
|---|---|---|---|---|
| 2014/0069124 | A1* | 3/2014 | Chang | F26B 3/08 62/63 |
| 2016/0348966 | A1 | 12/2016 | Alamzad | |
| 2017/0081481 | A1* | 3/2017 | Erbes | C08J 3/14 |
| 2019/0186832 | A1* | 6/2019 | Saribal | F26B 21/12 |

FOREIGN PATENT DOCUMENTS

| | | |
|---|---|---|
| JP | S63143944 | 6/1988 |
| JP | H09170878 | 6/1997 |

* cited by examiner

VIBRATORY APPARATUS WITH SEGMENTED DISTRIBUTOR DECK

BACKGROUND

This patent is directed to drying systems and methods, and, in particular, to fluidized bed drying systems and methods

SUMMARY

According to an aspect, a vibratory fluidized bed dryer includes a deck with a surface on which a bed of materials is formed, the deck having apertures through which air passes to fluidize the bed of materials on the deck, a source of air coupled to the apertures in the deck to supply air to the bed through the apertures in the deck, and a vibration generator coupled to the deck. The deck has at least two zones, each zone having a different open area percentage, such that the air passing through each zone produces a different superficial velocity.

According to another aspect, a method of drying materials exhibiting extended falling rate drying and/or case hardening characteristics includes disposing a bed of material on a deck, the deck having apertures through which air passes to fluidize the bed of materials on the deck arranged into at least two zones, each zone having a different open area percentage, such that the air passing through each zone produces a different superficial velocity. The method also includes passing air through the apertures of the at least two zones, and moving the bed of material across the deck from an inlet end to an outlet end.

According to a further aspect, a vibratory apparatus includes a deck with a surface on which a bed of materials is formed, the deck having apertures through which air passes to fluidize the bed of materials on the deck, wherein the deck has at least two zones, a first zone with a plurality of apertures arranged therein and a downstream second zone lacking apertures. A source of air is coupled to the apertures in the deck to supply air to the bed through the apertures in the deck, and a vibration generator coupled to the deck. A controller is coupled to the vibration generator and configured to vary the operation of the vibration generator to vary the conveying speed of material moving through the second zone.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings is necessarily to scale.

DETAILED DESCRIPTION OF VARIOUS EMBODIMENTS

A fluidized bed dryer is illustrated in the attached drawings, including a trough with a deck on which a bed of materials to be dried is formed. The trough and the deck have an inlet end and an outlet end. The deck also has passages through which air enters to pass through the bed of materials disposed on the deck. Consequently, the dryer also includes a source of air, preferably heated air, coupled to the passages in the deck to supply heated air to the bed through the passages in the deck. The introduction of the heated air causes the removal of water or other volatiles from the material disposed on the deck.

According to the illustrated embodiments, the dryer includes one or more vibration or vibratory generators coupled to the trough to move the bed of materials along the deck between the inlet end and the outlet end. While it is believed that the technology discussed herein may be used beneficially with any fluidized bed dryer, it is believed that the use of this technology with vibratory apparatuses configured as fluidized bed dryers provides particular benefits.

Figure 1:
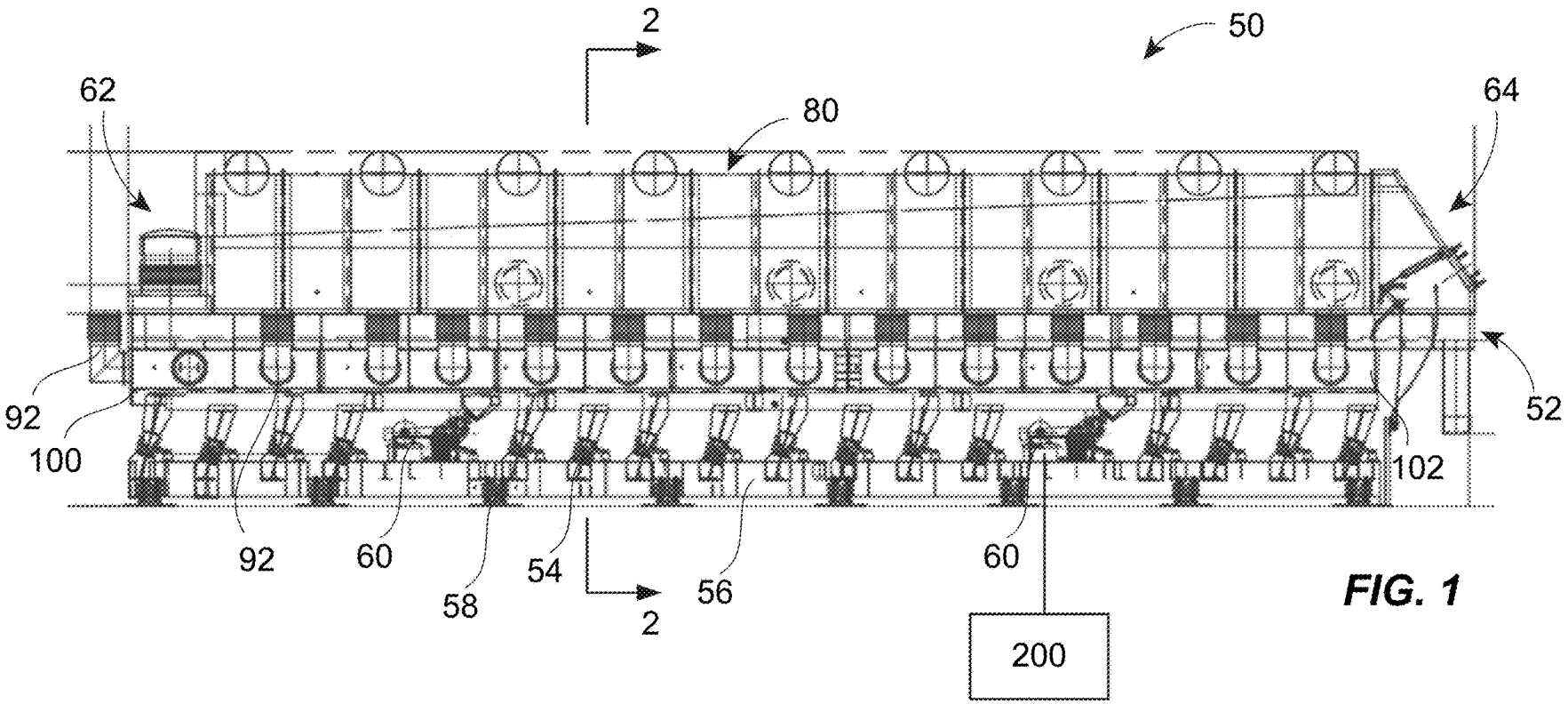
FIG. 1 is a side view of a fluidized bed dryer according to an embodiment of the present disclosure.

A first embodiment of a vibratory fluidized bed dryer 50 according to the present disclosure is illustrated in FIG. 1. The dryer 50 includes a trough 52 that is supported on a series of resilient member/link (also referred to as reactor spring/stabilizer) pairs 54 to a frame 56. In turn, the frame 56 is supported on the ground (e.g., a concrete floor) by a further plurality of resilient members (also referred to as isolation springs) 58 to limit the transmission of the vibrations of the dryer 50, and in particular the trough 52, to the floor. Also illustrated in FIG. 1 are one or more (as illustrated, two) vibration generators 60 (e.g., rotating eccentric drives) coupled to the trough 52 to move materials along the trough 52 between an inlet end 62 and an outlet end 64.

Figure 2:
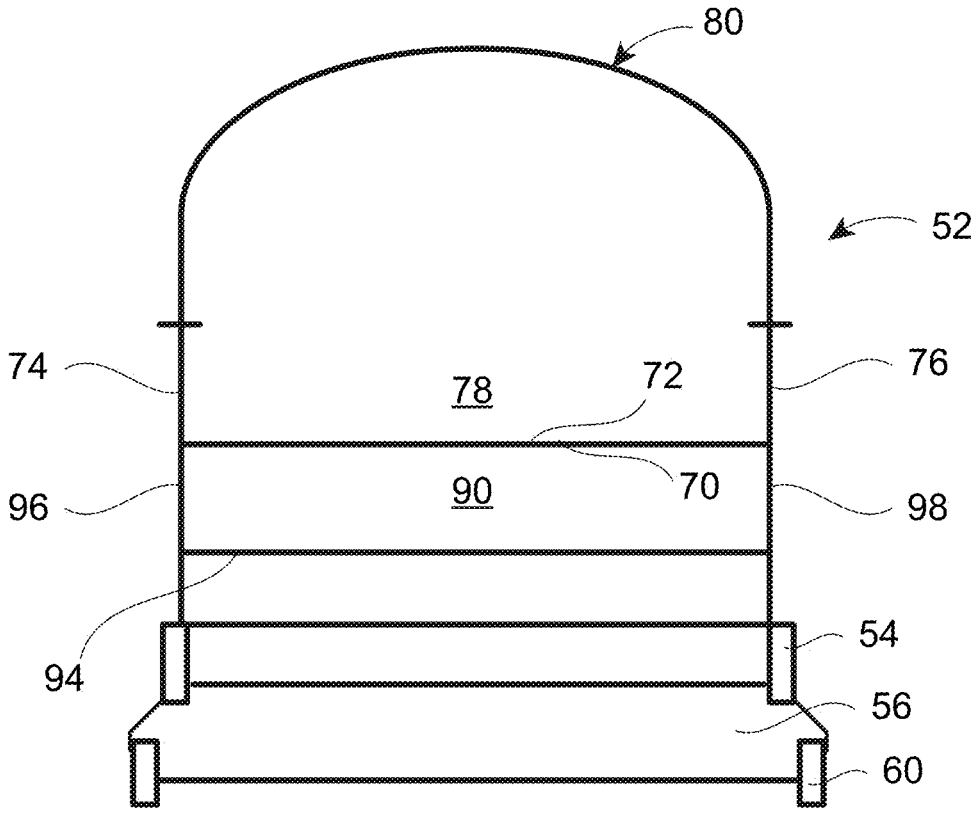
FIG. 2 is a cross-sectional view of the fluidized bed dryer of FIG. 1, taken along line 2-2 in FIG. 1.
Figure 3:
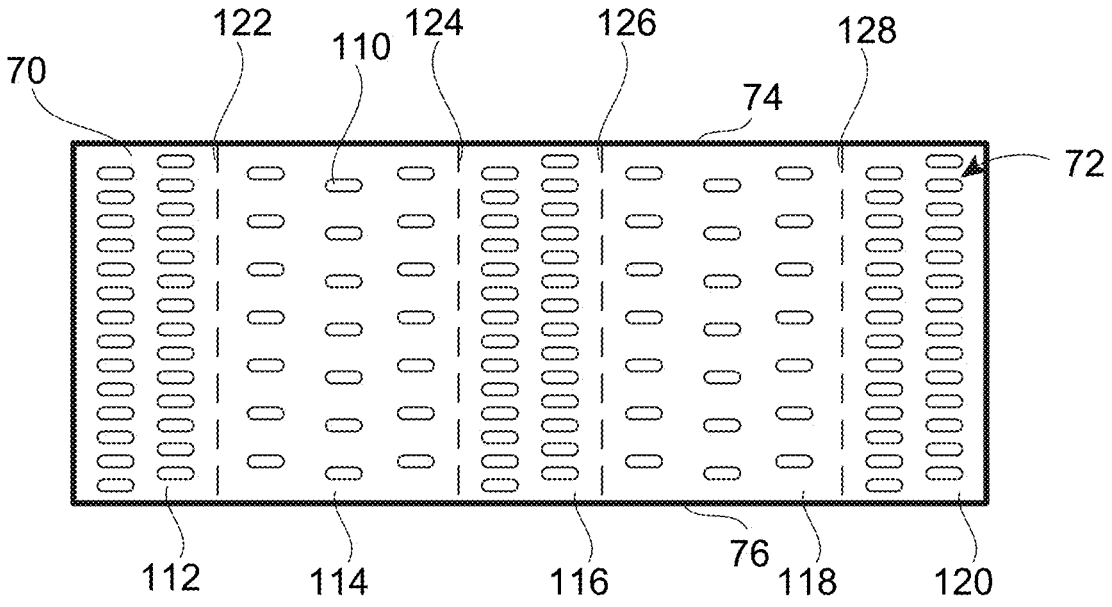
FIG. 3 is a plan view of the deck of the fluidized bed dryer of FIG. 1, with the hood removed.

Referring now to FIGS. 1-3, it will be recognized that the trough 52 includes a deck 70 (which may also be referred to as a distributor deck) with a surface 72 on which material may be disposed. As illustrated in FIG. 2, the surface 72 may be planar or flat, although that need not be the case according to all embodiments. For example, the surface 72 may be curved in cross-section as viewed in FIG. 2. Further, while the surface 72 may be relatively free of surface effects, according to other embodiments, the surface may have dimples or other structures formed on the surface thereof.

The trough 52 may also include two opposing side plates 74, 76 that depend from the deck 70, and that may be attached or joined to the deck 70. The plates 74, 76 and the deck 70 may define a space 78 in which a bed of material may be formed. While the deck 70 and side plates (or walls) 74, 76 define a rectangularly shaped, upwardly opening space 78, this should not be viewed as limiting the trough 52 described herein, but merely exemplary of the possible constructions that may be used for the trough 52.

A hood 80 is attached to the trough 52 to limit the escape of materials from the bed defined by the trough 52, as well as to collect the heated air that passes through the material bed in the space 78. In particular, the hood 80 may be attached or secured to the side plates 74, 76 so as to be disposed above the deck 70 of the trough 52, Alternatively, the hood 80 may be stationary relative to ground, and joined to the trough 52 by a flexible connection, such as a flexible seal or curtain. The hood 80 may have one or more apertures formed therethrough to direct the air collected, as will be discussed in detail below with reference to FIG. 4.

The trough 52 may also include a plenum 90 attached or defined below the deck 70. In turn, the plenum 90 may be coupled, via one or more flexible connectors 92 and conduits, to the source of the heated air, as explained in greater detail below with reference to FIG. 4. The plenum 90 may be defined by a bottom plate (or wall) 94, side plates (or walls) 96, 98, and end plates 100, 102 (see FIG. 1), as well as the deck 70. According to certain embodiments, the side walls 96, 98 of the plenum 90 may be formed by the same structural elements that defined the side walls 74, 76 of the trough 52 (i.e., a common plate may define both side wall 74 and side wall 96, for example).

Heated air passes from the plenum 90 through the deck 70 into the space 78 in which the bed of material is formed, the air being introduced both to dry the material and to fluidize the material bed. In particular, the deck 70 may include openings, apertures, passages or the like through which heated air passes from the plenum 90 into the space 78, as best seen at 110 in FIG. 3. To this extent, the deck 70 may be described as perforated or foraminous. The apertures 110 may be formed using a variety of methods on a single piece of material (e.g., metal plate), such as drilling or laser cutting, or by forming apertures in decks that are not fabricated from a single metal plate (e.g., wires).

The deck 70 may have two or more segments or zones, wherein the percentage of open area may be different between the segments or zones along the length of the deck (between the inlet 62 and the outlet 64). By varying the open area percentage, the superficial velocity may be engineered to provide controlled magnitude variations in degree of fluidization and air consumption. As illustrated, the deck 70 has five zones 112, 114, 116, 118, 120. The zones 112, 114, 116, 118, 120 are defined by interfaces 122, 124, 126, 128, with an interface 122 being between a first zone 112 and a second zone 114, an interface 124 being between the second zone 114 and a third zone 116, an interface 126 being between the third zone 116 and a fourth zone 118, and an interface 128 being between the fourth zone 118 and a fifth zone 120.

The interfaces 122, 124, 126, 128 may be represented by physical structures, or the interfaces may be defined by variations in the open space of the deck 70. As to the former, each of the zones 112, 114, 116, 118, 120 may be defined by a separate deck plate having spaced end edges, and the abutting end edges of adjacent deck plates may define the interfaces between the zones. As to the latter, one or more of the zones 112, 114, 116, 118, 120 may defined by a single deck plate, and the interface 112, 114, 116, 118, 120 may be defined by a change in the percentage open space between different regions of the deck plate.

Each of the zones 112, 114, 116, 118, 120 may be designed to have a different percentage of open area, and thus different velocities for the air exiting that zone 112, 114, 116, 118, 120. This is illustrated in a general sense in FIG. 3 by representing certain zones as having greater numbers of apertures 110 in a smaller area, or smaller numbers of apertures 110 in a greater area. It will be recognized that the differences in the percentage open area are not necessarily limited to changes in the density of the apertures 110 in the various zones. It is also possible to vary the apertures to provide a different percentage of area in each of the zones 112, 114, 116, 118, 120. For example, the dimensions and shape (elongated, circular, etc.) of the apertures 110 may be used to provide different open area percentages. According to certain embodiments, both the density of the apertures as well as the dimensions and/or shape of the apertures may be different to provide different open area percentages.

As to this latter point, while an embodiment has been illustrated where the apertures 110 have the same dimensions and shape (e.g., elongated) in each of the zones 112, 114, 116, 118, 120, this need not be the case according to all embodiments. In some embodiments, the apertures 110 may be circular in certain zones, elongated in others. Further, an aperture 110 may be elongated with a particular major axis dimension in some zones, and elongated with a different major axis dimension in other zones. Further, where the apertures are elongated, the major axis of the aperture need not be aligned with a longitudinal axis of the deck 70 or trough 52 as illustrated in FIG. 3; the major axes of the apertures may be at an angle to the longitudinal axis, for example.

While each of the zones may have a different open area percentage, it may be the case that certain zones have the same or substantially the same (e.g., within 5-10%) open area percentage, as illustrated in FIG. 3. As illustrated, the first, third, and fifth zones 112, 116, 120 have the same or substantially the same open area percentage, while the second and fourth zones 114, 118 have the same or substantially the same open area percentage. It may be said that the open area percentage alternates between the zones 112, 114, 116, 118, 120, or that zones of different open area percentage are disposed adjacent, or that a zone of different open area percentage is disposed between zones having a common open area percentage (in the case of zones 114, 118, for example).

Figure 4:
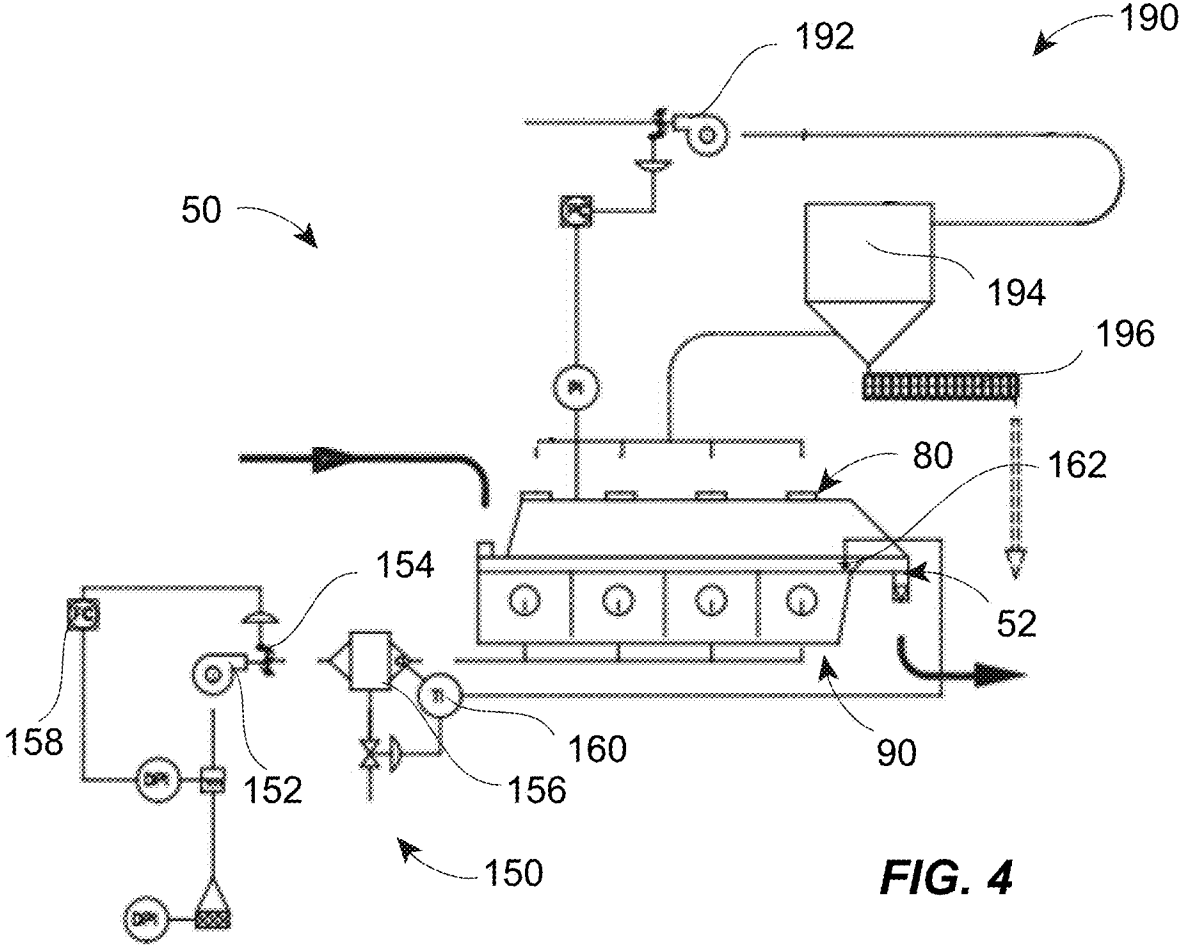
FIG. 4 is a schematic view of the fluidized bed dryer of FIG. 1, illustrating the source of heated air used in the dryer of FIG. 1, as well as downstream air processing equipment.

As stated previously, the dryer 50 includes a source of air coupled to the plenum 90, an exemplary embodiment of which is illustrated in FIG. 4. The illustrated source 150 is a source of heated air, and includes a fan 152 and an associated damper 154 in combination with an air heater 156 (which may be a natural gas-fired air heater, for example). The damper 154 (or more particularly, the actuator associated with the damper 154) may be coupled to an air mass flow controller 158, which may be programmed to provide a constant mass flow of drying air. The air heater 156 may be coupled in a similar fashion to an air temperature controller 160 (which may be separate from or defined by the same equipment as the air mass flow controller 158) that is in turn coupled to a sensor(s) 162 (such as a thermocouple) disposed at the outlet end 64 of the trough 52, which air temperature controller 160 may be programmed to vary the operation of the air heater 156 according to the temperature(s) within the material bed, for example.

The dryer 50 may also be connected to air processing equipment that handles the air leaving the dryer 50 via the hood 80. As illustrated in FIG. 4, the downstream exhaust air processing equipment 190 may include an exhaust air fan 192 that may be used to maintain a slight negative static pressure within the trough 52/hood 80 combination to limit expulsion of moisture and dust-laden air into the environment. The equipment 190 may also include a dust collector 194, with associated ancillary conveyors 196, for removal of fines and other materials that may become entrained in the air exiting the dryer 50.

One example of an application where an embodiment of a dryer 50 may be used relates to the drying of materials exhibiting extended falling rate drying and/or case hardening characteristics, such as synthetic rubbers or polymers for example. Such materials often require extended residence time at a controlled temperature to achieve a desired low residual moisture content. Use of fluidization is believed to be beneficial to the drying process because fluidization of the material bed can result in more thorough mixing of the material, leading to a more uniform temperature and moisture profile. The superficial velocity generated by conventional technology using a deck having a single open area percentage to produce the mixing phenomenon and bed temperature may also result in a rapid drying rate, however. This rapid drying rate can lead to case hardening, which actually is counterproductive because it inhibits the drying process by forming an impenetrable moisture barrier.

The structure of the dryer 50 may be used to provide varying or different open area percentages that permit extended residence time while reducing airflow requirements and rapid drying rate, which may lead to case hardening. In particular, it is believed that a deck with alternating zones of open area percentage (similar to that illustrated in FIG. 3) may produce a high degree of fluidization, mixing, and drying rate in one zone or segment followed by a zone or segment that exhibits a lower superficial velocity, while continuing to force air of the required air temperature through the polymer bed. The lower superficial velocity will reduce the drying rate while maintaining the overall bed temperature. This deck zone pattern may be repeated to achieve the required residence time and bed temperature at a reduced drying rate, avoiding case hardening while minimizing the overall airflow requirements. At the same time, these benefits may be obtained while using a single plenum that is in fluid communication with a single fan.

It will be recognized that a vibratory apparatus, such as the dryer 50, also may be configured to provide a deck free from mechanical means for obstructing (or varying) material flow, such as gates, walls, cantilevered fingers and the like that rise through a bed of material arranged on a surface of the deck. Conventionally, these mechanical means are used to obstruct, retard or impede material flow to control or produce a material bed to a desired depth. It is believed that these mechanical means for obstructing, retarding or impeding material flow can create handling and processing issues, however, especially with materials that tend to agglomerate, pack or agglutinate.

The mechanical means-free configuration described herein may be used in conjunction with the dryer technology described above, or it may be used separate from this technology. In fact, the configuration described below may be used with any vibratory apparatus that has at least a first section, or zone, that produces a fluidized bed and a second section, or zone, that is free of apertures to cause the material to be fluidized. For ease of illustration, the technology will be described in conjunction with the embodiments of the dryer 50, above.

According to this mechanical means-free technology, a vibratory apparatus, such as the dryer 50, includes a deck, such as the deck 70, with a surface 72 on which a bed of materials is formed, the deck 70 having apertures 110 through which air passes to fluidize the bed of materials on the deck, wherein the deck has at least two zones, a first zone (e.g., zones 112, 116, 120) with a plurality of apertures arranged therein and a downstream second zone lacking apertures, which zones may be defined by the interfaces 122, 124, 126, 128, for example. A source of air, which may include the fan 152 and the air heater 156, is coupled to the apertures 110 in the deck 70 to supply air to the bed through the apertures 110 in the deck 70, and a vibration generator 60 is coupled to the deck. A controller 200 is coupled to the vibration generator 60 and configured to vary the operation of the vibration generator 60 to vary the conveying speed of material moving through the second zone.

It will be recognized that the length (along the deck 70) of the second, non-apertured zones is relatively short in comparison to the length of the first zones in the embodiment illustrated, for example, in FIG. 3. It will be recognized that the relative lengths between the first and second zones is not intended to be limited to the illustrated embodiment of FIG. 3 the first and second zones may instead be of comparable length, or the second zones may be longer than the first zones. In a similar fashion, as illustrated in FIG. 3, even a relative short length of non-apertured deck may be used to control the bed depth of the first zone by controlling the conveying speed or rate of the material moving through the second zone.

As to the operation of this embodiment, it is believed that when material achieves a fluidized state, it may exhibit viscous fluid-like properties. For example, the material may tend to spread over the available surface area of the fluidizing zone or stage. It is also the case that as the depth of the material, also referred to as bed depth, increases, the residence time of the material in the zone or stage increases. The converse is also true, as the bed depth decreases, the residence time of the material in the zone or stage decreases. Consequently, control of the bed depth is important in fluidized zones or stages to achieve a particular effect on the material, e.g. a heat transfer effect.

As mentioned above, mechanical means for obstructing, retarding or impeding the rate of movement of the material along the trough may be used to control bed depth. This is a consequence of the rate of movement being determined by a combination of the feed rate of the material and the effect of these mechanical means. As also mentioned above, these mechanical means may not produce the desired variations in flow rate, and thus bed depth, when the material tends to agglomerate, pack or agglutinate.

To avoid such mechanical means, it has been recognized that in a vibratory apparatus where the material is not in a fluidized state, the material conveyance rate is governed by vibration parameters. These vibration parameters may include, for example, the speed of the motor (equipped with eccentric masses that defines, at least in part the vibration generator), the peak to peak displacement caused by the vibration generator, the angle of throw and the angle of the conveying surface (of the deck), whether incline or decline. Assuming a particular angle for the conveying surface (e.g., for fluidizing processes, the surface is often horizontal), the material conveyance rate may be varied by using one of the other vibration parameters.

By providing a zone or stage where the material is not in fluidized state downstream from a zone or stage where the material is fluidized, the control of one or more of the vibration parameters may be used to control the bed depth in the fluidized zone. That is, one or more of the vibration parameters (such as those mentioned above) may be used to control the material flow rate in the non-fluidized zone. Further, the control of the material flow rate has a direct effect on bed depth in the non-fluidized zone, which is believed in turn to have an effect on the bed depth in the fluidized zone.

In particular, it is recognized that the material conveyance rate in the non-fluidized zone will change the bed depth in the non-fluidized zone: slowing the material conveyance rate will cause the bed depth in the non-fluidized zone to increase (deepen); increasing the material conveyance rate will cause the bed depth to decrease (become shallow). Furthermore, this deepening or shallowing has an effect on the bed depth in the fluidized section: a deeper bed depth in the non-fluidized zone will cause the bed depth in the fluidized section to deepen, and a shallower bed depth in the non-fluidized zone will cause the bed depth in the fluidized section to lessen. Essentially, the bed depth in the non-fluidized zone acts as a barrier to the material exiting the fluidized zone. Consequently, control over the material conveyance rate via the vibration parameters in the downstream non-fluidized zone can be used to control (including maintain or change) the bed depth in the fluidized zone.

This technology may be used in conjunction with the dryer 50, for example, wherein the deck 70 has more than one zone with a plurality of apertures arranged therein: for example, the first zones mentioned above (e.g., 112, 116, 120) and third zones (e.g., 114, 118), referred to as such because of the reference to the aperture-free second zones, above. Each zone in either the first zones 112, 116, 120 or the third zones 114, 118 have a different open area percentage, such that the air passing through the zone produces a different superficial velocity. The second zones, that is the interfaces 122, 124, 126, 128, may be disposed between the first and third zones, that is between the zones 112, 116, 120 and the zones 114, 118.

In fact, the deck 70 may have a plurality of zones 112, 114, 116, 118, 120 with a plurality of apertures 110 arranged therein, including the first zones 112, 116, 120 and at least two third zones 114, 118, and a plurality of second zones 122, 124, 126, 128. The first zone, e.g., 116, may be disposed between at least two of the third zones 114, 118 and a second zone 124, 126 disposed between each of the first and third zones, 114, 116, 118. The deck may even have a plurality of zones 112, 114, 116, 118, 120 with a plurality of apertures 110 arranged therein including a plurality of first zones 112, 116, 120 and a plurality of third zones 114, 118, and a plurality of second zones 122, 124, 126, 128, the deck 70 alternating between one of the plurality of first zones 12, 116, 120 and one of the plurality of third zones 114, 118 with one of the plurality of second zones 22, 124, 126, 128 disposed between each of the first and third zones 112, 114, 116, 118, 120.

As was the case in the embodiments described above, the open area percentage of the first zones 112, 116, 120 may be different from the open area percentage of the third zones 114, 118 because a density of apertures in the first zones 112, 116, 120 is different from a density of apertures in the third zones 114, 118. As is also the case, the open area percentage of the first zones 112, 116, 120 may be different from the open area percentage of the third zones 114, 118 because a dimension or shape of the apertures in the first zones 112, 116, 120 is different from a dimension or shape of the apertures in the third zones 114, 118.

As to the control of the vibration parameters, the controller 200 may be used in conjunction with a variable frequency drive(s) or variable eccentric weight assemblies used in conjunction with the vibration generator. As to the former control technology, see U.S. Pat. No. 10,124,963, which is incorporated by reference in its entirety. As to the later control technology, see U.S. Pat. No. 9,238,229, which also is incorporated by reference in its entirety.

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

Moreover, while the foregoing was discussed relative to materials exhibiting extended falling rate drying and/or case hardening characteristics, it will be recognized that the usefulness of the foregoing dryer is not limited to the materials discussed herein.

What is claimed is:

1. A vibratory fluidized bed dryer comprising:

a deck with a surface on which a bed of materials is formed, the deck having apertures through which air passes to fluidize the bed of materials on the deck;

first and second opposing side walls depending from the deck;

a source of air coupled to the apertures in the deck to supply air to the bed through the apertures in the deck; and a vibration generator coupled to the deck configured to move the bed of materials along the deck, wherein the deck has at least two zones, each zone extending between the first opposing side wall and the second opposing side wall and between a first upstream interface and a second downstream interface spaced from the first upstream interface along a length of the deck, and each zone having a different open area percentage defined by the apertures in the deck, such that the air passing through each zone produces a different superficial velocity wherein the deck has a plurality of zones, the plurality of zones including a first zone having a first open area percentage and a plurality of second zones having a second open area percentage, the first zone disposed between at least two of the second zones.

2. The dryer according to claim 1, wherein the source of air is a source of heated air including a single fan and an air heater.

3. The dryer according to claim 1, wherein the deck has a plurality of zones, the plurality of zones including a first plurality of zones having a first open area percentage and a second plurality of zones having a second open area percentage, the deck alternating between one of the first plurality of zones and one of the second plurality of zones.

4. The dryer according to claim 1, wherein the open area percentage of one of the at least two zones is different from the open area percentage of another of the at least two zones because a density of apertures in the one of the at least two zones is different from a density of apertures in the another of the at least two zones.

5. The dryer according to claim 1, wherein the open area percentage of one of the at least two zones is different from the open area percentage of another of the at least two zones because a dimension or shape of the apertures in the one of the at least two zones is different from a dimension or shape of the apertures in the another of the at least two zones.

6. The dryer according to claim 1, further comprising a single plenum disposed beneath the deck and in fluid communication with the source of air and the apertures in the deck.

7. The dryer according to claim 1, wherein the apertures are elongated with a major axis aligned with a longitudinal axis of the deck.

8. The dryer according to claim 1, wherein the deck lacks all mechanical means for obstructing material flow.

9. A method of drying materials exhibiting extended falling rate drying and/or case hardening characteristics, comprising:

disposing a bed of material on a deck, the deck having apertures through which air passes to fluidize the bed of materials on the deck arranged into at least two zones, each zone extending between a first opposing side wall and a second opposing side wall and between a first upstream interface and a second downstream interface spaced from the first upstream interface along a length of the deck, and each zone having a different open area percentage defined by the apertures in the deck, such that the air passing through each zone produces a different superficial velocity;

wherein the deck has a plurality of zones, the plurality of zones including a first zone having a first open area percentage and a plurality of second zones having a second open area percentage, the first zone disposed between at least two of the second zones;

passing air through the apertures of the at least two zones; and operating a vibration generator coupled to the deck to cause the bed of material to move across the deck from an inlet end to an outlet end.

10. The method according to claim 9, further comprising heating air, the heated air passing through the apertures of the at least two zones.

11. The method according to claim 9, wherein the deck has a plurality of zones, the plurality of zones including a first plurality of zones having a first open area percentage and a second plurality of zones having a second open area percentage, the deck alternating between one of the first plurality of zones and one of the second plurality of zones.

12. The method according to claim 9, further comprising passing the air through a single plenum prior to passing the air through the apertures of the at least two zones.

13. The method according to claim 9, wherein the materials exhibiting extended falling rate drying and/or case hardening characteristics comprise synthetic rubber or polymers.

14. The method according to claim 9, wherein the deck lacks all mechanical means for obstructing material flow.

* * * * *